US008206034B2

(12) United States Patent
Keen et al.

(10) Patent No.: US 8,206,034 B2
(45) Date of Patent: Jun. 26, 2012

(54) OPENING MECHANISM FOR A FLEXIBLE CONTAINER

(75) Inventors: Stephen Ashton Keen, Narre Warren (AU); Vincent Papaluca, Glen Iris (AU)

(73) Assignee: Entapack Pty Ltd, Dandenong, Victoria (AU)

( * ) Notice: Subject to any disclaimer, the term of this patent is extended or adjusted under 35 U.S.C. 154(b) by 983 days.

(21) Appl. No.: 12/221,311

(22) Filed: Aug. 1, 2008

(65) Prior Publication Data

US 2009/0046958 A1 Feb. 19, 2009

(30) Foreign Application Priority Data

Aug. 1, 2007 (AU) ..... 2007904134

(51) Int. Cl.
*B67D 1/00* (2006.01)

(52) U.S. Cl. ..... 383/202; 222/91

(58) Field of Classification Search ..... 383/202; 222/80, 81, 82, 83, 85, 84, 88, 89, 91, 260, 222/265, 277, 288, 566, 567, 568, 570, 571
See application file for complete search history.

(56) References Cited

U.S. PATENT DOCUMENTS

| | | | | |
|---|---|---|---|---|
| 4,603,793 | A | 8/1986 | Stern | |
| 4,796,788 | A | 1/1989 | Bond | |
| 5,002,202 | A | 3/1991 | Karpisek | |
| 5,129,212 | A | 7/1992 | Duffey et al. | |
| 5,141,133 | A * | 8/1992 | Ninomiya et al. | 222/83 |
| 5,249,695 | A * | 10/1993 | Luch et al. | 220/276 |
| 5,390,814 | A | 2/1995 | Christine et al. | |
| 5,467,581 | A | 11/1995 | Everette | |
| 5,680,970 | A | 10/1997 | Smith et al. | |
| 5,899,359 | A | 5/1999 | Smith et al. | |
| 5,961,001 | A | 10/1999 | Davis et al. | |
| 6,182,426 | B1 | 2/2001 | Pritchard | |
| 6,347,785 | B1 | 2/2002 | Copp et al. | |
| 6,477,743 | B1 * | 11/2002 | Gross et al. | 222/525 |
| 6,637,725 | B2 | 10/2003 | Davis et al. | |
| 7,004,209 | B2 | 2/2006 | Davis et al. | |
| 7,261,226 | B2 * | 8/2007 | Adams et al. | 222/521 |
| 7,895,811 | B2 | 3/2011 | Caudle | |
| 2004/0124212 | A1 * | 7/2004 | Masuda | 222/183 |

FOREIGN PATENT DOCUMENTS

| | | | |
|---|---|---|---|
| JP | 10035778 | A | 2/1998 |
| WO | WO 93/00268 | A1 | 1/1993 |
| WO | WO 96/02458 | A1 | 2/1996 |

* cited by examiner

*Primary Examiner* — Nathan J Newhouse
*Assistant Examiner* — Nina Attel
(74) *Attorney, Agent, or Firm* — Mark B. Quatt

(57) ABSTRACT

An opening mechanism for use with a fluid filled collapsible container is disclosed. The mechanism comprises an outlet spout adapted to be joined to a wall of the collapsible container, a perforator for opening the collapsible container through the outlet spout and a driver having a passage therethrough. The driver is received within the outlet spout and screw threadedly engaged therewith for advancement by relative rotation thereof to drive the perforator though the outlet spout to thereby open the collapsible container and permit fluid to be dispensed through the passage. A circumferential flexible seal is provided within the outlet spout on one of the driver and the outlet spout to engage with the other of the driver and the outlet spout to reduce leakage of fluid between the outlet spout and the driver as the collapsible container is opened.

4 Claims, 6 Drawing Sheets

OPENING MECHANISM FOR A FLEXIBLE CONTAINER

The present application claims the benefit of priority Australian Patent Application Serial No. 2007904134 filed Aug. 1, 2007.

FIELD OF THE INVENTION

The present invention relates to mechanisms used to open flexible containers containing fluids in order that the contents can be dispensed.

BACKGROUND

Flexible containers for fluids are known in which there is an outer substantially rigid container and an inner collapsible container for the fluid. The inner collapsible container can be filled with a fluid and the contents can be dispensed without the need for air to enter the inner container thereby to avoid oxidation and deterioration of the contents. For example, wine and other liquids are dispensed from what have become known as bag-in-box containers.

Containers of this type are also known for industrial type applications to package larger quantities of fluids. For example, bulk containers are used to hold in the order of 1,000 liters of liquid or paste. In these containers there is often a pallet such as a wooden pallet or the like supporting an outer substantially rigid container which may be made of, for example, metal, timber or cardboard. The inner collapsible container may be made of polymeric film such as polyethylene and may include several layers of film to provide strength, oxygen barrier and other characteristics as required.

Such industrial type containers may include an inlet towards the top through which liquids may be introduced to the collapsible container and an outlet welded or otherwise joined to a wall of the collapsible container. The outlet includes an outlet spout which can extend through openings in the walls of the inner and outer containers and through which the contents can be dispensed. Prior to use, that is during storage and transport, a membrane extends across the outlet spout to seal the outlet.

One way of opening the outlet from such a collapsible container is by means of a cutting assembly including a cutting tool comprising a serrated edge and a ball-valve assembly. The cutting assembly is attached to the outlet spout and the ball-valve is moved to the "open" position. The cutting tool is inserted through the ball-valve and advanced manually by extending a plunger supporting the tool. The membrane sealing the outlet spout is punctured by the cutting tool, but fluid cannot yet be dispensed because the cutting tool forms a seal in the cutting assembly. The tool is manually retracted back past the ball-valve, which is then moved to the "closed" position thereby providing a seal. The cutting tool is removed and fluid product can be dispensed from the container when the ball-valve is opened. Fluid can be dispensed from the outlet spout as desired either by pump or under gravity.

An advantage of this opening method is that, as the collapsible container is opened, there is relatively little leakage of fluid because the cutting assembly is securely affixed in position during the opening procedure. However, opening the container with the cutting assembly requires a valve system and it would be desirable to provide an opening mechanism that has fewer parts and is relatively simple to use.

Accordingly, it is an aim of the present invention to provide an opening mechanism that is easy to use while still providing minimal leakage as the container is opened and, preferably, once the container has been opened.

SUMMARY OF THE INVENTION

In one form, although this is not necessarily the only or broadest form, there is provided an opening mechanism for use with a fluid filled collapsible container, the mechanism comprising:

an outlet spout adapted to be joined to a wall of the collapsible container;

a perforator for opening the collapsible container through the outlet spout; and a driver having a passage therethrough, the driver being received within the outlet spout and screw threadedly engaged therewith for advancement by relative rotation thereof to drive the perforator through the outlet spout to thereby open the collapsible container and permit fluid to be dispensed through the passage;

wherein a circumferential flexible seal is provided within the outlet spout on one of the driver and the outlet spout to engage with the other of the driver and the outlet spout to reduce leakage of fluid between the outlet spout and the driver as the collapsible container is opened.

In another form, there is provided a collapsible container assembly comprising:

a collapsible container;

an outlet spout extending from a wall of the collapsible container;

a perforator for opening the collapsible container through the outlet spout; and a driver having a passage therethrough, the driver being received within the outlet spout and screw threadedly engaged therewith for advancement by relative rotation thereof to drive the perforator through the outlet spout to thereby open the collapsible container and permit fluid to be dispensed through the passage;

wherein a circumferential flexible seal is provided within the outlet spout on one of the driver and the outlet spout to engage with the other of the driver and the outlet spout to reduce leakage of fluid between the outlet spout and the driver as the collapsible container is opened.

The perforator opens the collapsible container by advancing through the outlet spout and perforating a film or membrane that otherwise prevents the contents of the collapsible container from flowing out through the outlet spout. The film is provided across the outlet spout, preferably adjacent to the collapsible container, that is an inner end of the outlet spout. The film may be polymeric and is welded or otherwise attached to seal the outlet spout. Alternatively, or in addition, a film or a further film can be a portion of the wall of the collapsible container to which the outlet spout is joined.

During opening of the collapsible container the pressure of the fluid under gravity tends to force it through any openings to which it has access between the outlet spout and the driver, for example, between the opposed threads thereof. The circumferential flexible seal acts as a barrier, physically reducing the possibility that fluid can leak from the collapsible container through any flow paths formed between the outlet spout and the driver.

The opening mechanism of the present invention allows the collapsible container to be opened with reduced leakage without the need for a complex valving arrangement and is therefore relatively simple to use. Hitherto, leakage during opening was a particular problem when using drivers having at least 5 threads per inch (2 threads per centimeter (cm)). While these drivers allow for relatively quick advancement of the driver into the outlet spout, they have not been used previously without the valving system described above, because of the leakage problem during opening.

BRIEF DESCRIPTION OF THE FIGURES

A preferred embodiment of the invention will now be described with reference to the following drawings, which are schematics that are not to scale and are intended to be exemplary only, and in which.

DESCRIPTION OF PREFERRED EMBODIMENTS OF THE INVENTION

Figure 1:
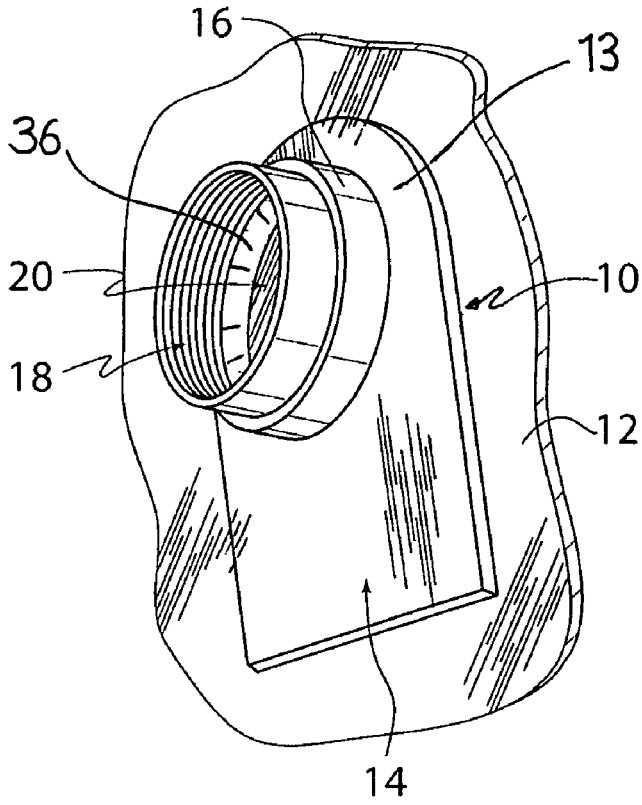
FIG. 1 is a perspective view of an outlet spout of the opening mechanism joined to a collapsible container.

The collapsible container of the present invention may be made of any suitable film material or laminated films of material as is known in the art. A multilayered film comprising polypropylene or polyethylene film is particularly suitable for this purpose. The collapsible container is preferably shaped generally to correspond with the shape of the rigid container (not shown) in which it is to be housed so that, when full, it will extend to and press against the walls of the rigid container to be supported thereby. Preferably the collapsible container is marginally greater in size than the rigid container to ensure that the collapsible container does not need to support the weight of the contents itself. Neither the rigid container nor the collapsible container form part of the present invention and they will therefore not be described further.

The collapsible container may include a fluid inlet preferably on its upper wall and through which fluid may be introduced into the collapsible container. The inlet may include an inlet spout to extend through an inlet opening in the collapsible container and an inlet flange by which the inlet spout may be joined to the collapsible container. An inlet cap may be provided by which the inlet spout may be closed or opened. This may include for example a screw threaded cap. The inlet may be made of any suitable material, for example, polyethylene. The fluid inlet does not form part of the present invention and it will therefore not be described further.

The collapsible container also includes a fluid outlet through which fluid may be dispensed from the collapsible container. Preferably, the fluid is a liquid; however the fluid can be a gas or a paste. It is desirable that the material of the outlet and the material of the collapsible container, where they are joined, be compatible for joining, preferably by a welding technique, as is known in the art. For example, both the material of the collapsible container and the portion of the outlet joined to the collapsible container may be formed of polypropylene or polyethylene. The outlet spout extends from the outlet component and may be provided with an outlet cap or valve, which may be screw threadedly or otherwise affixed thereto, before opening. The outlet component may include an outlet flange extension that, in use, extends from adjacent the outlet spout to a position substantially adjacent the junction of a side wall and a bottom wall of the rigid container to provide support of the outlet. Such a flange extension is described in WO 93/00268.

Before the collapsible container is opened, a film or membrane extends across the outlet spout in a manner known in the art to seal the outlet until specifically opened for dispensing of the fluid contents of the collapsible container. The sealing film can be a polymeric film or membrane separate to or discrete from the collapsible container and welded or otherwise attached to the outlet so as to seal the outlet spout. Preferably the seal is at an end of the outlet spout adjacent to the collapsible container, that is an inner end of the outlet spout. In this embodiment, prior to use, the outlet with the sealing film is placed over or through an aperture provided in the wall of the collapsible container and welded to the material of the collapsible container so as to close the aperture. Alternatively, or in addition, the sealing film or a further film can be a portion of the wall of the collapsible container to which the outlet spout is joined. In this embodiment, the outlet is joined to the collapsible container without forming an aperture in the wall of collapsible container.

FIG. 1 shows outlet component 10 in position on a wall of collapsible container 12. The wall may form any part of the collapsible container, for example, the side, the top or the bottom of the collapsible container. The outlet component 10 has a flange 13, which can be welded to the container wall. Alternatively, the flange and container material may be bonded using an adhesive. Preferably, flange 13 is affixed to the inside surface of the container wall, but this is not essential. In the embodiment shown in FIG. 1, outlet component 10 has a flange extension 14, which may also be affixed to the surface of the collapsible container.

Outlet spout 16 extends outwardly from flange 13 and from container 12 and has an inside tubular surface that has a screw thread 18. In a preferred embodiment the inside diameter of the outlet spout is approximately 2 inches (5.1 cm). Sealing film 20 is shown extending across the outlet spout 16 at the innermost end of the spout.

The outlet component 10 is shown in sectional view from above in FIGS. 4 to 7, so that the flange extension 14 is not visible. A flexible seal 36 is shown extending around the outlet spout 16, projecting inwardly from the inner end of the screw thread 18. The flexible seal 36 is illustrated more clearly in FIG. 4 and is described hereinafter with reference to FIGS. 5 to 7.

Figure 2:
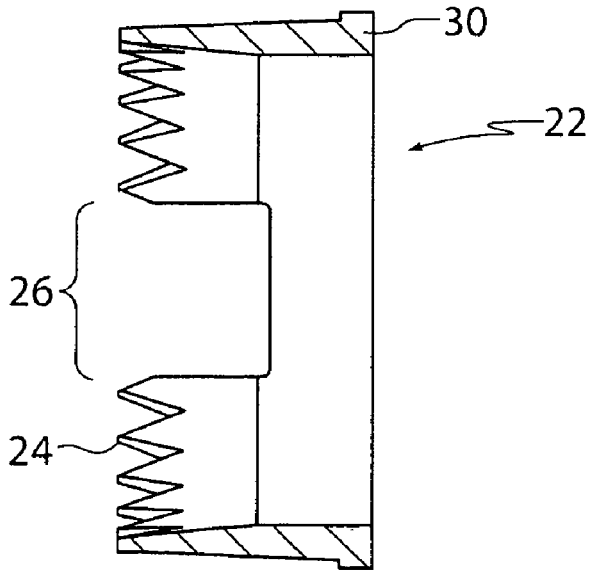
FIG. 2 is a sectional side view of a perforator of the opening mechanism.

FIG. 2 shows a perforator according to a preferred embodiment of the invention. The perforator is annular and substantially cylindrical with a diameter smaller than the diameter of the outlet spout. The skilled person would appreciate from the following description that the perforator can have a shape other than cylindrical, for example, a polygonal shape. The perforator 22 is for cutting the sealing film 20 to open the collapsible container and to do so has a serrated cutting edge 24. Other cutting edges that are capable of cutting through the film could be used instead of the illustrated triangular shaped cutting teeth, as would be appreciated by those skilled in the art. The perforator can be made of a hard plastic such as polypropylene. However, it should be understood that it can be made of any material which is capable of perforating the film and is suitable for use in the industry.

Figure 3:
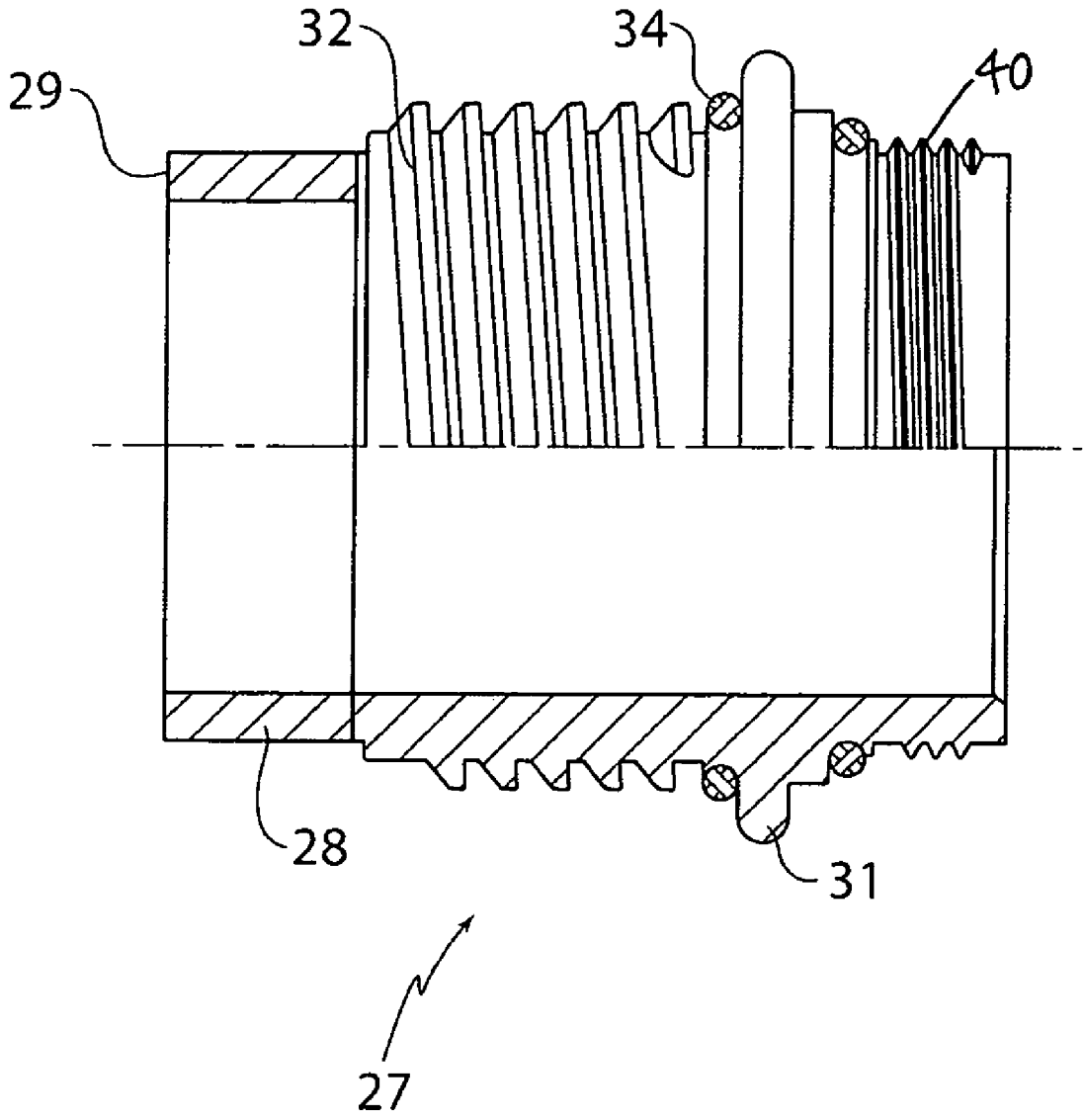
FIG. 3 is a part-sectional side view of a driver of the opening mechanism.
Figure 4:
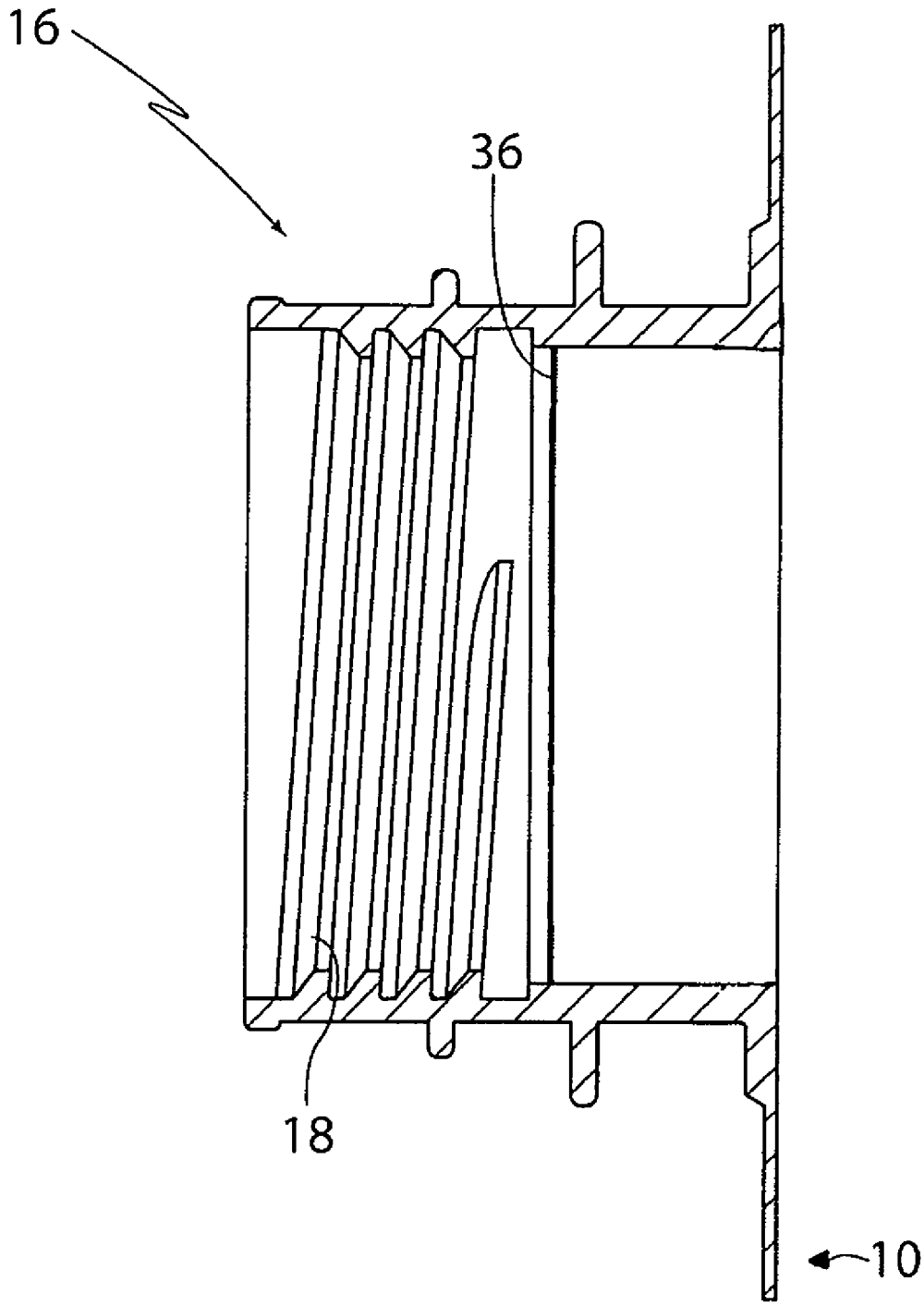
FIG. 4 is a part sectional view from above of the outlet spout of FIG. 1.

In order to drive the perforator through the outlet spout and into film 20, a driver 27 as shown in FIG. 3 is used. The driver can also be referred to as a buttress, or a BSP male or a male nipple. In some instances, the driver is referred to as a buttress male nipple.

Driver 27 is received within outlet spout 16 and engages with it by means of screw thread 32. Through rotation of the driver, the driver is capable of driving or advancing perforator 22, with which it abuts, into sealing film 20 when the user wishes to open the container. The screw thread 32 mates with the internal thread 18 on outlet spout 16. The outlet spout 16 and the corresponding screw thread 18 are shown fully mated in cross-section in FIG. 7. The screw threads are preferably at least 5 threads per inch (2 threads per cm) for relatively quick advancement of the driver into the outlet spout. However, the driver may have about 11 threads per inch (about 4 threads per cm), or more.

Figure 5:
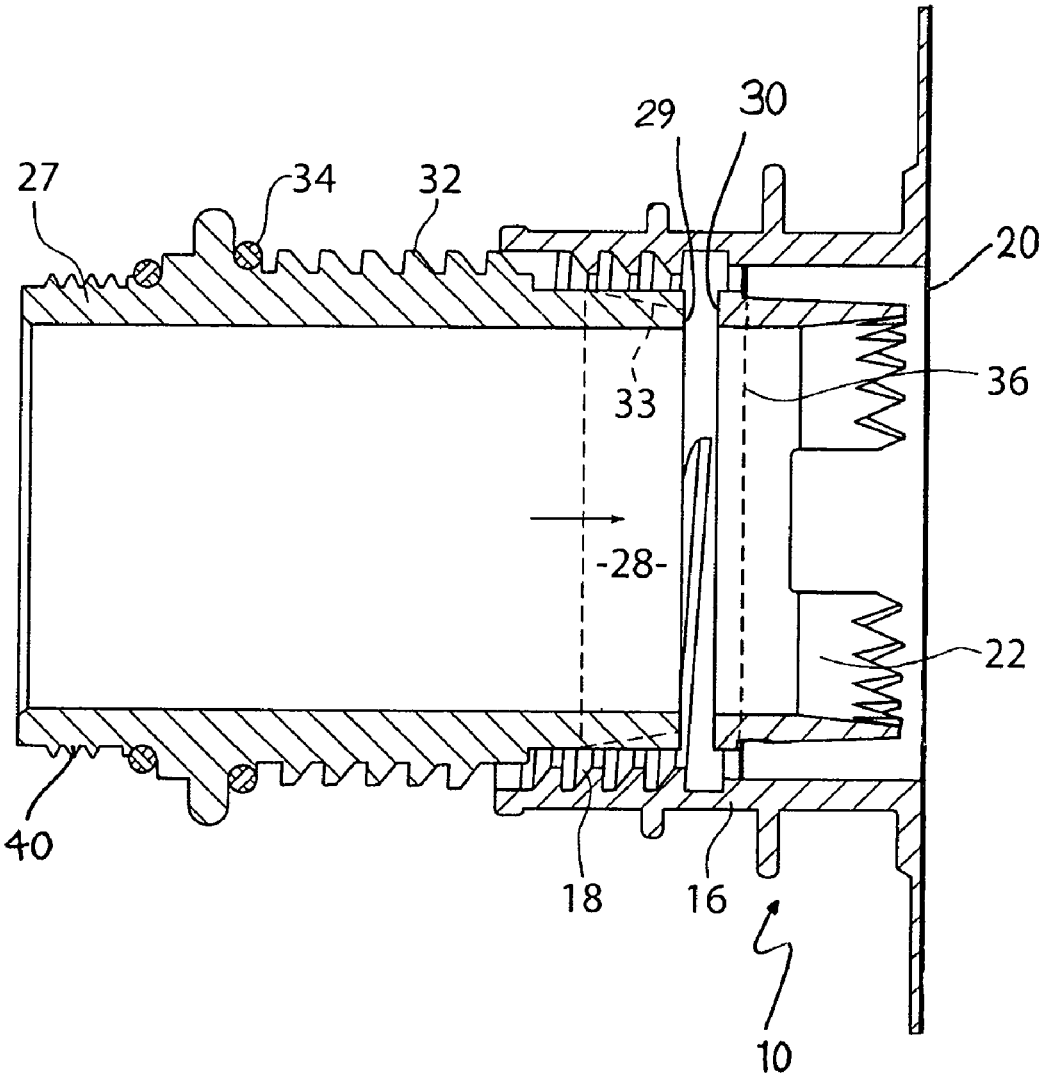
FIG. 5 is a part-sectional view of the opening mechanism prior to opening of the collapsible container.

FIG. 5 is a schematic showing the opening mechanism just before the opening procedure. All components of the opening mechanism are shown assembled, including outlet component 10 with outlet spout 16, perforator 22 and driver 27. As driver 27 is advanced forward (in the direction of the arrow shown) the screw threads 32 and 18 engage and the driver can be rotated further into the outlet spout by the user. As the driver is advanced into the outlet spout it will drive or force the perforator forward (without rotation) through the outlet spout into film 20 thereby cutting the film and opening the collapsible container.

FIG. 3 shows that driver 27 has a driving end or leading end referred to as a spigot 28. Spigot 28 preferably has a substantially flat circumferential surface extending forward of screw thread 32. Driver 27 engages with perforator 22 by means of an end wall 29 of spigot 28 which contacts at least a part of the end wall 30 on perforator 22. The spigot 28 extends forward of the screw thread on the driver to a distance sufficient to engage with perforator 22 at about the same time as screw thread 32 first engages with screw thread 18 of outlet spout 16.

In the embodiment shown, the perforator has a gap 26 in the cutting edge formation 24. This ensures that the portion of film 20 cut by the perforator is not complete. Accordingly, the cut film 20 remains attached to the outlet component 10 and is not lost into the fluid in the container. Although not preferred, it is possible that the driver and perforator are integral with one another. If this is the case, the perforator would rotate with the driver rather than being advanced with minimal or no rotation. If the perforator rotates, the advantage of gap 26 in the perforator cutting formation is lost.

Driver 27 has an axial passage through its centre through which fluid can be dispensed from the container once the container is opened. The fluid that is dispensed from the container can be collected by the user (who may be the same or a different person to whoever opened the container). To prevent liquid from being dispensed immediately after the container is opened, a valve dispenser (not shown) can be screw threadedly attached to driver 27 by screw thread 40. The valve dispenser can remain in the closed position until dispensing is required. When the user wishes to dispense liquid from the container, the valve dispenser can be opened to allow fluid to flow from the container through the axial passage in the driver and out through the dispenser.

As the collapsible container is opened by the opening mechanism, the pressure of the fluid forces it through any gaps that exist between driver 27 and outlet spout 16. The likelihood of leakage during opening is increased if the screw threads on the driver and outlet spout are not fully mated and sealing means, such as an O-ring 34, are not functional (see FIG. 7). If the screw threads on the driver and outlet spout have a relatively wide gauge, for example 5 threads per inch (2 threads per cm), leakage between the outlet spout and driver is more likely to occur. In order to reduce this leakage during opening, the circumferential flexible seal or barrier 36 is provided within the outlet spout. This seal can be on the driver to engage with the outlet spout, or the seal can be on the outlet spout to engage with the driver. Either way, the circumferential flexible seal or barrier within the outlet spout reduces the likelihood of unwanted leakage of fluid as the container is opened.

Figure 6:
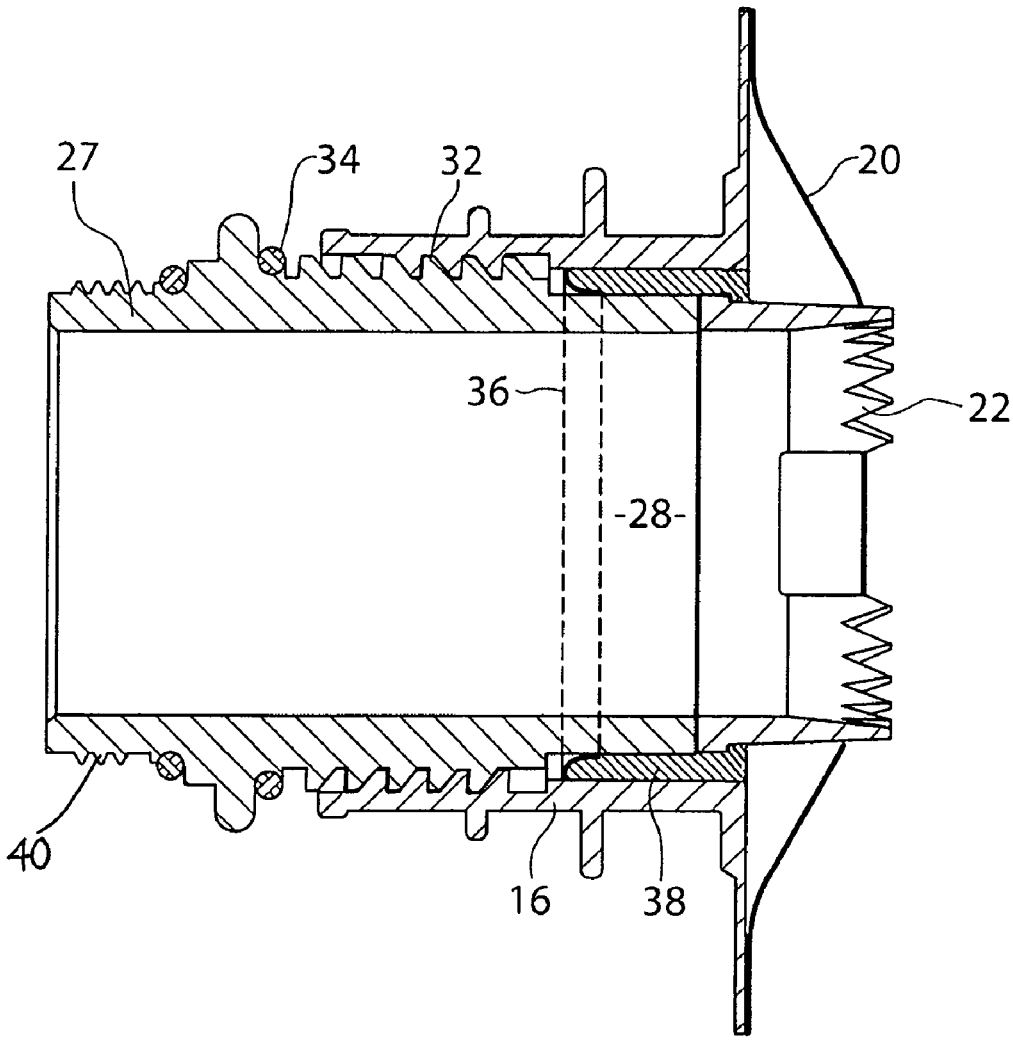
FIG. 6 is a part-sectional view of the opening mechanism once the collapsible container has been perforated.

The flexible seal 36 works in the following way. As driver 27 is inserted into outlet spout 16, spigot 28 is advanced until is contacts with the end wall 30 of the perforator. As described above, this preferably coincides with the first mating of screw threads 18 and 32. FIG. 6 shows that as perforator 22 is further advanced by rotation of the driver the collapsible container is perforated (opened) and fluid is immediately released under pressure. Fluid released into the opening mechanism around perforator 22 is indicated by numeral 38 in FIG. 6. Fluid would also be released through perforator 22 and driver 27, but this is not shown for clarity.

During the opening procedure the circumferential flexible seal 36 contacts around the entire outer circumferential surface of spigot 28. In FIG. 6 the deformation of the flexible seal can be seen as it is pressed against the spigot 28. Seal 36 reduces the possibility that fluid released from the container during opening can pass to the screw thread arrangement 18 and 32. As the driver is advanced, seal 36 slides along spigot 28.

In the embodiment illustrated, the circumferential flexible seal 36 is integral with the inside surface of the outlet spout and extends therefrom. Alternatively, the circumferential seal could be integral with the spigot 28 of driver 27 and extend from the outside surface of the driver. In some embodiment, the seal is not integral, but is attached to the outlet spout or the driver. In the Figures, the circumferential flexible seal is shown as a circumferential fin 36. However, optionally, the circumferential flexible seal can be an O-ring located within the outlet spout, for example, the O-ring could be attached around the outside circumferential surface of spigot 28 of driver 27 (not shown). Any such O-ring must be made from a suitably deformable material to allow for insertion of the driver into the outlet spout with the O-ring attached.

In order to provide a sealing function, the seal 36 extends from the inside surface of the outlet spout 16 (or from spigot 28 of the driver) by a length slightly greater than the distance between the spigot 28 and the inside surface of outlet spout 16. However, any length that is sufficient to prevent or reduce leakage of the liquid between the outlet spout and the driver could be used, for example, the seal could be exactly the distance between the spigot and the outlet spout. Typically, with an outlet spout having a diameter of 2 inches (about 5 cm) and a spigot having an outside diameter of 4.3 cm, the circumferential flexible fin shown in the figures extends approximately 0.5 cm (5 mm) from the inside surface of the spout.

The seal 36 should be sufficiently flexible to allow the driver to pass into and be advanced through the outlet spout but not so flexible as to allow fluid released from the container to force its way past the seal. A preferred material for the circumferential flexible fin, and therefore of the outlet spout 16 with which it can be integral is low density polyethylene. In order to facilitate the insertion and the advancement of driver 27, the end wall 29 of spigot 28 can be profiled to assist it to pass over the seal. For example, the spigot end could have a rounded profile or be tapered (the latter is shown by the dotted lines indicated by numeral 33 in FIG. 5).

Figure 7:
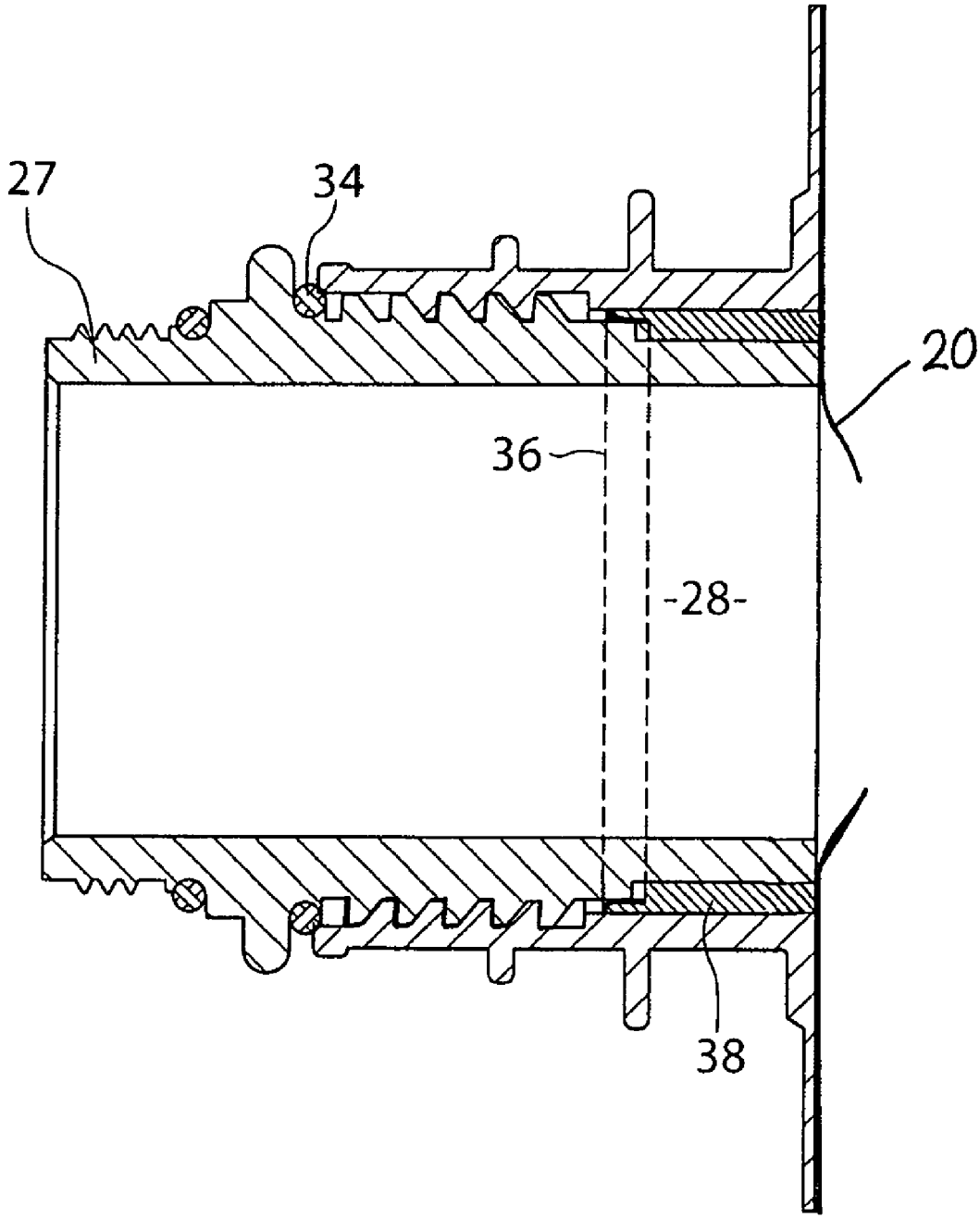
FIG. 7 is a part-sectional side view of the opening mechanism once the collapsible container is opened and the driver has been fully advanced.

FIG. 7 shows that once the screw threads 18 and 32 are fully mated, the circumferential flexible seal 36 is positioned adjacent to the termini of the screw threads, serving to further reduce possible leakage once the container has been opened.

Optionally, more than one fin can be provided in the opening mechanism. Leakage when the driver is fully advanced, as shown in FIG. 7, is also reduced by O-ring 34 which abuts the circumferential flange 31 on driver 27, engaging the outer end of outlet spout 16 and thereby sealing the driver against the outlet spout.

Those skilled in the art will appreciate that the invention described herein is susceptible to variations and modifications other than those specifically described. It is to be understood that the invention includes all such variations and modifications which fall within its spirit and scope.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The invention claimed is:

1. An opening mechanism for use with a fluid filled collapsible container, the mechanism comprising:

a) an outlet spout adapted to be joined to a wall of the collapsible container, the outlet spout having an inside surface;

b) a perforator for opening the collapsible container through the outlet spout; and c) a driver having a passage therethrough, the driver comprising i) a screw thread, and ii) a spigot extending forward of the screw thread, and engageable with the perforator, the spigot having an outer circumferential surface, the driver adapted to be received within the outlet spout and screw threadedly engageable therewith for advancement by relative rotation thereof to drive the perforator through the outlet spout to thereby open the collapsible container and permit fluid to be dispensed through the passage;

wherein a circumferential flexible seal is provided within the outlet spout to engage with the spigot to reduce leakage of fluid between the outlet spout and the spigot as the collapsible container is opened; and wherein the circumferential flexible seal is a fin seal, and extends from the inside surface of the outlet spout, and the circumferential flexible seal is adapted to contact around the entire outer circumferential surface of the spigot, and to deform as the driver is advanced toward the collapsible container.

2. The opening mechanism according to claim 1, wherein the circumferential flexible seal is integral with the inside surface of the outlet spout and extends therefrom.

3. A collapsible container assembly comprising:

a) a collapsible container;

b) an outlet spout extending from a wall of the collapsible container, the outlet spout having an inside surface;

c) a perforator for opening the collapsible container through the outlet spout; and d) a driver having a passage therethrough, the driver comprising i) a screw thread, and ii) a spigot extending forward of the screw thread, and engageable with the perforator, the spigot having an outer circumferential surface, the driver adapted to be received within the outlet spout and screw threadedly engageable therewith for advancement by relative rotation thereof to drive the perforator through the outlet spout to thereby open the collapsible container and permit fluid to be dispensed through the passage;

wherein a circumferential flexible seal is provided within the outlet spout to engage with the spigot to reduce leakage of fluid between the outlet spout and the spigot as the collapsible container is opened; and wherein the circumferential flexible seal is a fin seal, and extends from the inside surface of the outlet spout, and the circumferential flexible seal is adapted to contact around the entire outer circumferential surface of the spigot, and to deform as the driver is advanced toward the collapsible container.

4. The collapsible container assembly according to claim 3, wherein, the circumferential flexible seal is integral with the inside surface of the outlet spout and extends therefrom.

* * * * *